US009520668B2

(12) United States Patent
Schmidt et al.

(10) Patent No.: US 9,520,668 B2
(45) Date of Patent: Dec. 13, 2016

(54) METHOD AND APPARATUS FOR CRIMPING AN ELECTRICAL TERMINAL TO AN ELECTRICAL WIRE

(71) Applicants: Tyco Electronics Corporation, Berwyn, PA (US); Tyco Electronics AMP GmbH, Bensheim (DE)

(72) Inventors: Helge Schmidt, Speyer (DE); Marjorie Kay Myers, Mount Wolf, PA (US); Christopher J. Karrasch, Boiling Springs, PA (US)

(73) Assignees: TYCO ELECTRONICS CORPORATION, Berwyn, PA (US); TE CONNECTIVITY GERMANY GMBH, Bensheim (DE)

( * ) Notice: Subject to any disclaimer, the term of this patent is extended or adjusted under 35 U.S.C. 154(b) by 698 days.

(21) Appl. No.: 13/871,706

(22) Filed: Apr. 26, 2013

(65) Prior Publication Data

US 2014/0317922 A1 Oct. 30, 2014

(51) Int. Cl.
*H01R 43/04* (2006.01)
*H01R 13/422* (2006.01)
(Continued)

(52) U.S. Cl.
CPC ..... *H01R 13/422* (2013.01); *H01R 4/62* (2013.01); *H01R 43/048* (2013.01); *H01R 4/08* (2013.01);
(Continued)

(58) Field of Classification Search
CPC ..... Y10T 29/49185; Y10T 29/49181; Y10T 29/49174; Y10T 29/49117; Y10T 29/49002; H01R 13/422
(Continued)

(56) References Cited

U.S. PATENT DOCUMENTS 3,251,216 A 5/1966 Broske
3,612,748 A 10/1971 James
(Continued)

FOREIGN PATENT DOCUMENTS

CN 201455038 U * 5/2010
EP 0944130 A2 9/1999
(Continued)

OTHER PUBLICATIONS

International Search Report, International Application No. PCT/US2014/034749, International Filing Date, Apr. 21, 2014.
ISR for PCT/US2011/001754 dated Oct. 14, 2011.

*Primary Examiner* — Peter DungBa Vo
*Assistant Examiner* — Azm Parvez

(57) ABSTRACT

A method is provided for crimping an electrical terminal to an electrical wire having electrical conductors. The method includes positioning the electrical wire and the electrical terminal between opposing crimp tooling members of a crimp tool. The method also includes pressing a crimp barrel of the electrical terminal against the electrical conductors of the electrical wire using the crimp tooling members such that the electrical conductors are mechanically and electrically connected to the crimp barrel. The crimp barrel is pressed against the electrical conductors such that at least some contact portions of metallic surfaces of at least some of the electrical conductors melt and form hot weld bonds with one or more contact portions of the metallic surface of one or more adjacent electrical conductors.

9 Claims, 5 Drawing Sheets

(51) Int. Cl.

| | |
|---|---|
| ***H01R 4/62*** | (2006.01) |
| ***H01R 43/048*** | (2006.01) |
| *H01R 4/08* | (2006.01) |
| *H01R 4/18* | (2006.01) |

(52) U.S. Cl.
CPC ..... *H01R 4/187* (2013.01); *Y10T 29/49185* (2015.01); *Y10T 29/53213* (2015.01)

(58) Field of Classification Search
USPC ..... 29/863, 861, 857, 825, 592.1, 748
See application file for complete search history.

(56) References Cited

U.S. PATENT DOCUMENTS

| | | | | |
|---|---|---|---|---|
| 3,878,318 | A | 4/1975 | Ziegler, Jr. et al. | |
| 3,955,044 | A | 5/1976 | Hoffman et al. | |
| 4,142,771 | A | 3/1979 | Barnes et al. | |
| 4,932,906 | A | 6/1990 | Kaley et al. | |
| 5,532,433 | A | 7/1996 | Endo et al. | |
| 5,561,267 | A | 10/1996 | Fudoo et al. | |
| 5,852,868 | A * | 12/1998 | Soriano | H01R 43/048 29/33 M |
| 5,966,806 | A * | 10/1999 | Maeda | B30B 15/148 29/857 |
| 7,048,562 | B2 | 5/2006 | Lutsch et al. | |
| 7,306,495 | B2 | 12/2007 | Hashimoto et al. | |
| 7,775,842 | B2 | 8/2010 | Yamagami | |
| 7,938,694 | B2 | 5/2011 | Hiramitsu et al. | |
| 2004/0029454 | A1 * | 2/2004 | Onuma | H01R 11/28 439/747 |
| 2007/0155235 | A1 | 7/2007 | De Keyser et al. | |
| 2010/0144189 | A1 | 6/2010 | Watanabe et al. | |
| 2011/0094797 | A1 * | 4/2011 | Otsuka | H01R 43/0207 174/84 C |
| 2013/0059487 | A1 * | 3/2013 | Sulek | B23K 1/0008 439/884 |

FOREIGN PATENT DOCUMENTS

| | | | |
|---|---|---|---|
| JP | 2010049941 | A | 3/2010 |
| WO | 2011/125348 | A1 | 10/2011 |

* cited by examiner

METHOD AND APPARATUS FOR CRIMPING AN ELECTRICAL TERMINAL TO AN ELECTRICAL WIRE

BACKGROUND OF THE INVENTION

The subject matter described and/or illustrated herein relates generally to electrical terminals that terminate wires.

Electrical terminals are often used to terminate the ends of wires. Such electrical terminals typically include an electrical contact and a crimp barrel. The crimp barrel includes an opening that receives an end of the wire therein. The crimp barrel is crimped around the end of the wire to establish an electrical connection between the one or more conductors of the wire and the terminal as well as to mechanically hold the electrical terminal on the wire end. When crimped over the wire end, the crimp barrel establishes an electro-mechanical connection between the conductor(s) of the wire and the electrical contact.

Conductors of wires are often fabricated from copper, copper alloys, copper clad steel, etc. However, as the cost of copper has risen, aluminum has represents a lower cost alternative conductor material. But, using aluminum as a conductor material is not without disadvantages. For example, one disadvantage of using aluminum as a conductor material is an oxide and/or other surface material (e.g., residual wire extrusion enhancement materials) layer that may build on the exterior surface of the conductor when the conductor is exposed to atmosphere and/or during processing of the conductor. For example, such aluminum oxide layers can have relatively poor electrical connection properties as compared to metallic aluminum. Such oxide and/or other surface material layers may be formed on other conductor materials, but can be especially difficult to deal with for aluminum. Accordingly, such exterior conductor surface oxide layers must be penetrated to contact the aluminum material to establish a reliable electromechanical connection between a wire and an electrical terminal and/or to establish a reliable electrical connection between different conductors of the wire. But, it may be difficult to displace enough of the oxide layer to achieve a sufficient electrical and mechanical bond, and thereby establish a reliable electrical connection, because of the tenacity and relatively high speed at which the oxide layer forms on the conductors. For example, as a conductor wipes against another conductor and/or the electrical terminal during crimping, the oxide layer of the conductor(s) can be displaced to expose the aluminum material of the conductor(s). But, it may be difficult to displace enough of the oxide layer to achieve a sufficient electrical and mechanical bond during the crimping operation and/or before new oxide forms on the exposed aluminum material.

BRIEF DESCRIPTION OF THE INVENTION

In an embodiment, a method is provided for crimping an electrical terminal to an electrical wire having electrical conductors. The method includes positioning the electrical wire and the electrical terminal between opposing crimp tooling members of a crimp tool. The method also includes pressing a crimp barrel of the electrical terminal against the electrical conductors of the electrical wire using the crimp tooling members such that the electrical conductors are mechanically and electrically connected to the crimp barrel. The crimp barrel is pressed against the electrical conductors such that at least some contact portions of metallic surfaces of at least some of the electrical conductors melt and form hot weld bonds with one or more contact portions of the metallic surface of one or more adjacent electrical conductors.

In an embodiment, a crimp tool is provided for crimping an electrical terminal to an electrical wire having electrical conductors. The crimp tool includes a base and a pair of opposing crimp tooling members held by the base. The crimp tooling members are configured to move toward and away from each other along a crimping axis. The crimp tooling members include pressing surfaces that are configured to engage in physical contact with a crimp barrel of the electrical terminal. A crimp zone is defined between the pressing surfaces of the crimp tooling members. The crimp zone is configured to receive an assembly of the electrical wire and the electrical terminal. The crimp tool includes an actuator that is operatively connected to at least one of the crimp tooling members for moving the at least one crimp tooling member relative to the base. The actuator is configured to move the crimp tooling members toward each other along the crimping axis such that the crimp tooling members press the crimp barrel of the electrical terminal against the electrical conductors of the electrical wire and such that at least some contact portions of metallic surfaces of at least some of the electrical conductors melt and form hot weld bonds with one or more contact portions of the metallic surface of one or more adjacent electrical conductors.

In an embodiment, a crimp tool is provided for crimping an electrical terminal to an electrical wire having electrical conductors. The crimp tool includes a base and a pair of opposing crimp tooling members held by the base. The crimp tooling members are configured to move toward and away from each other along a crimping axis. The crimp tooling members include pressing surfaces that are configured to engage in physical contact with a crimp barrel of the electrical terminal. A crimp zone is defined between the pressing surfaces of the crimp tooling members. The crimp zone is configured to receive an assembly of the electrical wire and the electrical terminal. The crimp tool includes an actuator that is operatively connected to at least one of the crimp tooling members for moving the at least one crimp tooling member relative to the base. The actuator is configured to move the crimp tooling members toward each other along the crimping axis at a speed of at least approximately 30 meters per second.

DETAILED DESCRIPTION OF THE INVENTION

Figure 1:
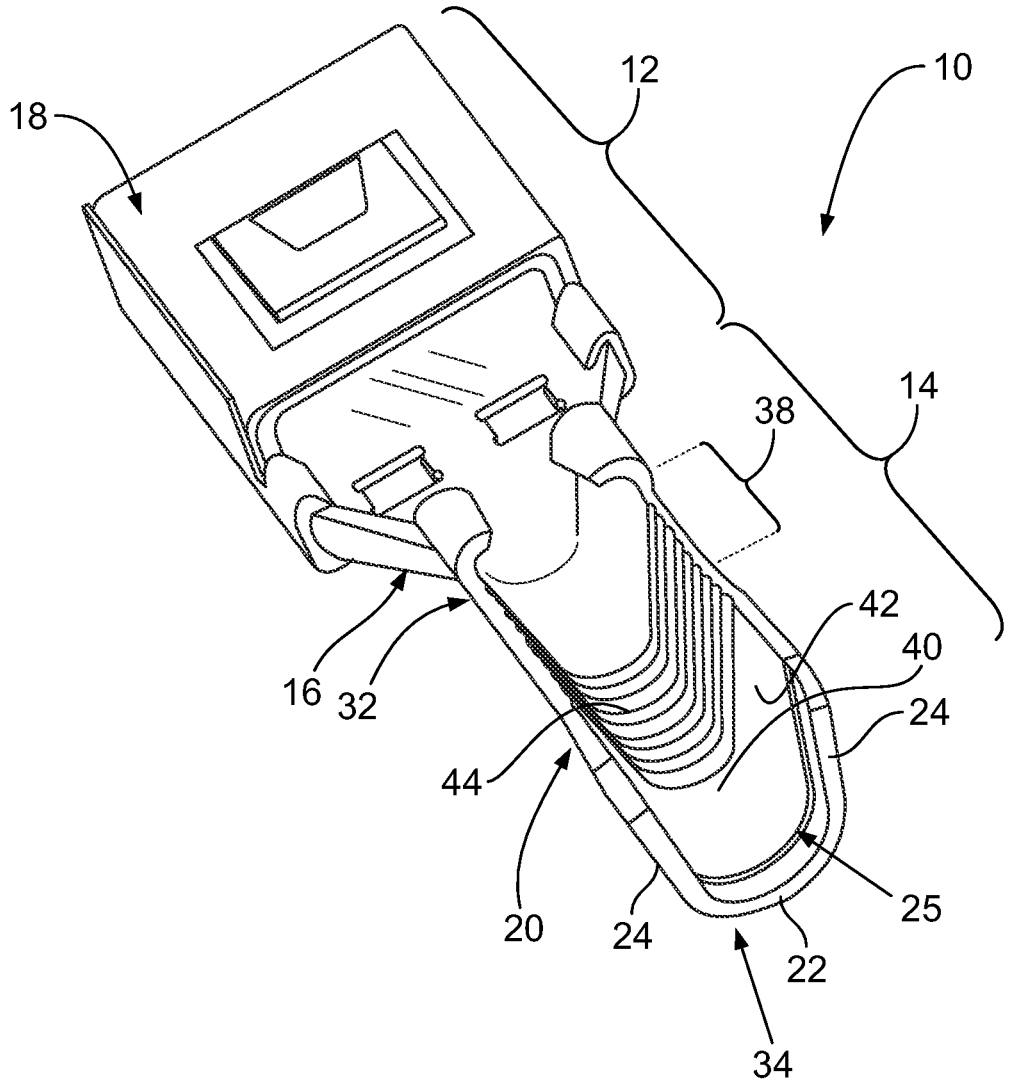
FIG. 1 is a perspective view of an embodiment of an electrical terminal.

FIG. 1 is a perspective view of an embodiment of an electrical terminal 10. The terminal 10 includes an electrical contact segment 12 and a crimp segment 14 that extends from an end 16 of the electrical contact segment 12. The electrical contact segment 12 includes an electrical contact 18. In the illustrated embodiment, the electrical contact 18 is a receptacle that is configured to receive a mating contact (not shown) therein. But, the electrical contact 18 shown herein is meant as exemplary only. The electrical terminal 10 is not limited to the electrical contact 18 shown herein, but rather the electrical terminal 10 may include any type of electrical contact 18, such as, but not limited to, a crimp barrel, a spring contact, a beam contact, a tab, a structure having an opening for receiving a threaded or other type of mechanical fastener, and/or the like.

The crimp segment 14 includes a crimp barrel 20. The crimp barrel 20 includes a base 22 and opposing side walls 24 that extend from the base 22. The base 22 and the side walls 24 define an opening 25 of the crimp barrel 20 that is configured to receive an end 26 (FIGS. 2-4 and 6) of an electrical wire 28 (FIGS. 2-6) that includes one or more electrical conductors 30 (FIGS. 2-6).

The crimp barrel 20 is configured to be crimped around the end 26 of the electrical wire 28 to mechanically and electrically connect the electrical wire 28 to the electrical terminal 10. Optionally, the electrical wire 28 includes an electrical insulation layer 36 (FIGS. 2, 4, and 6) extending around the electrical conductors 30 along at least a portion of the length of the electrical conductors 30. The electrical insulation layer 36 is optionally removed from at least a portion of ends of the electrical conductors 30 for exposing the conductor ends. In some alternative embodiments, the electrical contact 18 is another crimp barrel 20 that is configured to be crimped around the end of another electrical wire (not shown) to mechanically and electrically connect the other electrical wire to the electrical terminal 10. Accordingly, in some alternative embodiments, the electrical terminal 10 is configured electrically connect the electrical wire 28 to another electrical wire. In other words, the electrical terminal 10 may be used to splice the electrical wire 28 to another wire in some alternative embodiments.

The crimp barrel 20 extends a length from a contact end 32 to a wire end 34. The contact end 32 extends from the electrical contact 18. More particularly, the contact end 32 extends from the end 16 of the electrical contact segment 12. The crimp barrel 20 includes an electrical termination crimp sub-segment 38 that engages in physical contact with the electrical conductors 30 to electrically connect the crimp barrel 20 to the electrical conductors 30.

In the illustrated embodiment, the base 22 and the side walls 24 extend along and define the entirety of the length of the crimp barrel 20. The base 22 includes an interior surface 40, and each of the side walls 24 includes an interior surface 42. The interior surfaces 40 and 42 define boundaries of the opening 25 of the crimp barrel 20. Optionally, the interior surfaces 40 and/or 42 include one or more serrations 44 for penetrating an oxide and/or other surface material (such as, but not limited to, residual wire extrusion enhancement materials, and/or the like) layer that has built up on the electrical conductors 30. The interior surfaces 40 and 42 may each be referred to herein as a "metallic surface" of the crimp barrel 20.

The electrical terminal 10 may be fabricated from any materials, such as, but not limited to, copper, a copper alloy, copper clad steel, aluminum, nickel, gold, silver, a metal alloy, and/or the like. One or more portions (e.g., the crimp barrel 20) or all of the electrical terminal 10 may fabricated from a base metal and/or metal alloy that is coated (e.g., plated and/or the like) with another material (e.g., another metal and/or metal alloy). For example, one or more portions or all of the electrical terminal 10 may be fabricated from a copper base that is plated with nickel.

The electrical conductors 30 may be fabricated from any materials, such as, but not limited to, aluminum, an aluminum alloy, copper, a copper alloy, copper clad steel, nickel, gold, silver, a metal alloy, and/or the like. In the illustrated embodiment, the electrical conductors 30 are fabricated from aluminum.

Figure 2:
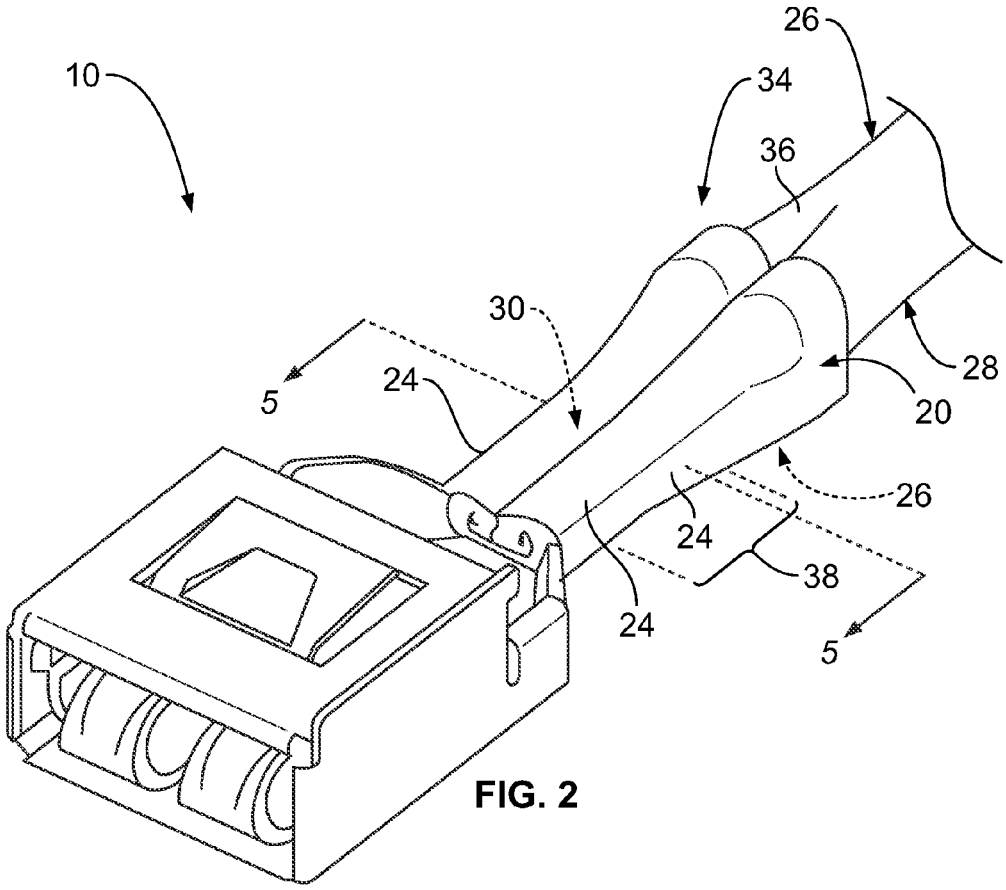
FIG. 2 is a perspective view of the electrical terminal shown in FIG. 1 illustrating the electrical terminal after the electrical terminal has been crimped around the end of an electrical wire.

FIG. 2 is a perspective view of the electrical terminal 10 illustrating the electrical terminal 10 after the crimp barrel 20 has been crimped around the end 26 of the electrical wire 28. As can be seen in FIG. 2, the side walls 24 have been crimped over the wire end 26 such that the side walls 24 are folded over and such that the end 26 of the electrical wire 28 is mechanically connected to the crimp barrel 20 of the electrical terminal 10. The crimp barrel 20 is crimped along sub-segment 38 such that the electrical conductors 30 of the electrical wire 28 are electrically connected to the crimp barrel 20 of the electrical terminal 10. The wire end 34 of the crimp barrel 20 optionally engages the electrical insulation layer 36 (if provided) when the electrical wire 28 is crimped to the electrical terminal 10, as is shown in FIG. 2.

In the illustrated embodiment, the crimp between the electrical terminal 10 and the electrical wire 28 is an "F" type crimp. But, the crimp between the electrical terminal 10 and the electrical wire 28 may be any other type of crimp, such as, but not limited to, a "W" type crimp, an "O" type crimp, and/or the like. Moreover, the specific size, shape, and/or the like of the crimp barrel 20 that is shown and/or described herein is meant as exemplary only. It should be understood that the specific shape, size, and/or the like of the crimp barrel 20 may depend on the type of crimp, such that the crimp barrel 20 may have other shapes, sizes, and/or the like for other types of crimps than the F type crimp shown herein.

Figure 3:
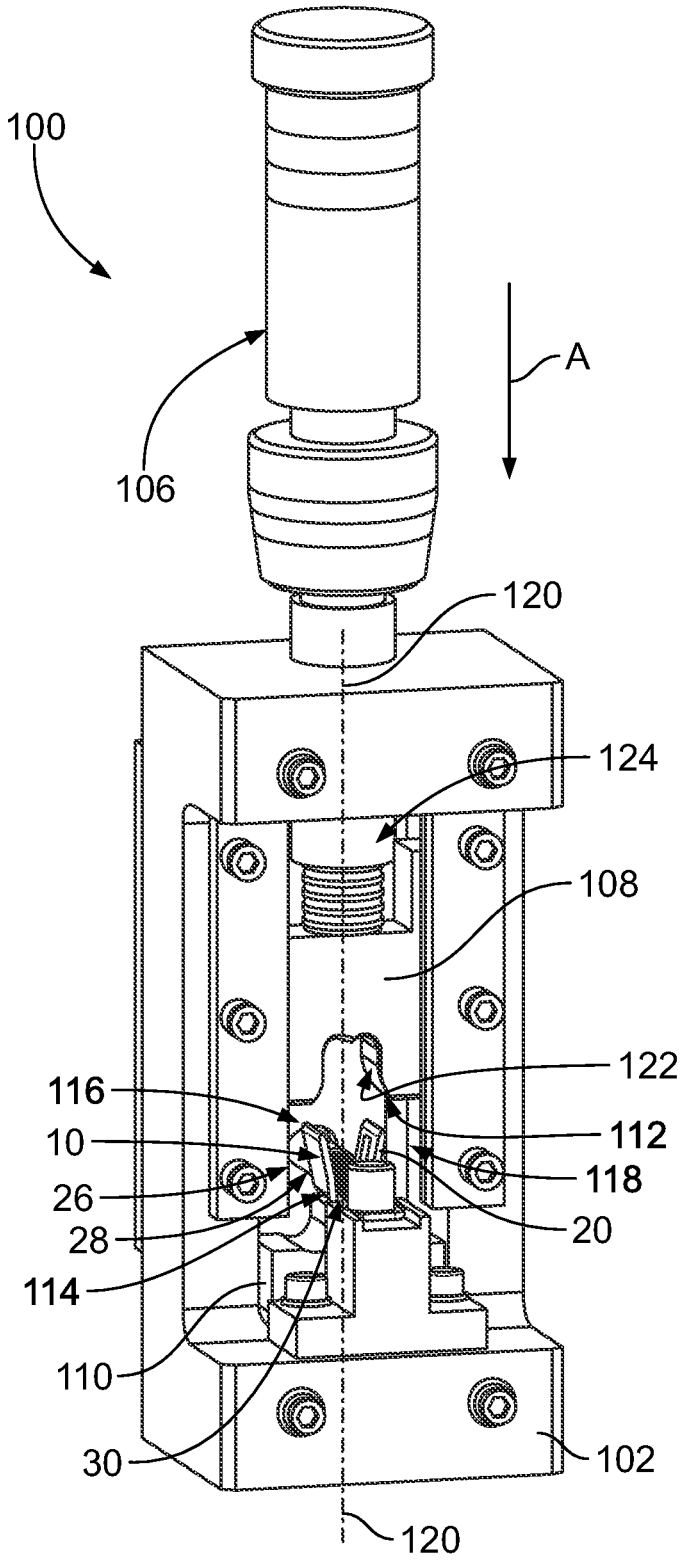
FIG. 3 is a perspective view of an embodiment of a crimp tool for crimping the electrical terminal shown in FIGS. 1 and 2 to the electrical wire shown in FIG. 2.

FIG. 3 is a perspective view of an embodiment of a crimp tool 100 for crimping the electrical terminal 10 to the electrical wire 28. The crimp tool 100 includes a base 102, an actuator 106, and a pair of opposing crimp tooling members 108 and 110. The crimp tooling members 108 and 110 include respective pressing surfaces 112 and 114 that define an opening 116 therebetween. The opening 116 defines a crimp zone 118 of the crimp tool 100. The crimp tooling members 108 and 110 are configured to move toward and away from each other along a crimping axis 120. The actuator 106 is operatively connected to the crimp tooling member 108 and/or the crimp tooling member 110 for moving the crimp tooling member 108 and/or 110 relative to the base 102. The actuator 106 is configured to move the crimp tooling member 108 and/or the crimp tooling member 110 relative to the base 102 to thereby move the crimp tooling members 108 and 110 toward each other along the crimping axis 120.

In operation of the crimp tool 100, an assembly of the electrical terminal 10 and the end 26 of the electrical wire 28 is positioned in the crimp zone 118 between the crimp tooling members 108 and 110. The actuator 106 is actuated to move the crimp tooling members 108 and 110 toward each other along the crimping axis 120. As the crimp tooling members 108 and 110 move toward each other along the crimping axis 120, the pressing surfaces 112 and 114 of the crimp tooling members 108 and 110, respectively, engage in physical contact with the crimp barrel 20 of the electrical terminal 10 such that the crimp tooling members 108 and 110 press the crimp barrel 20 against the electrical conductors 30 of the electrical wire 28. The crimp tooling members 108 and 110 thereby crimp the end 26 of the electrical wire 28 to the crimp barrel 20 of the electrical terminal 10 such that the electrical wire 28 is electrically and mechanically connected to the electrical terminal 10.

As discussed above, the crimp tooling members 108 and 110 oppose each other. Specifically, the crimp tooling members 108 and 110 are positioned along the crimping axis 120 such that the respective pressing surfaces 112 and 114 of the crimp tooling members 108 and 110 face each other. In the illustrated embodiment, the crimp tooling member 108 is movable relative to the base 102 and along the crimping axis 120 toward and away from the crimp tooling member 110, which remains stationary relative to the base 102 as the crimp tooling member 108 moves relative to the base 102. In other words, the exemplary crimp tool 100 includes a stationary crimp tooling member 110 and a movable crimp tooling member 108. Alternatively, in addition or alternative to the crimp tooling member 108, the crimp tooling member 110 is configured to move along the crimp axis 120 relative to the base 102. In other words, in some alternative embodiments, the crimp tool 100 includes two movable crimp tooling members. Moreover, in still other embodiments, the crimp tooling members 108 and 110 are pivotally connected together at a hinge (not shown) such that the crimp tooling members 108 and 100 define a jaw. The stationary crimp tooling member 110 of the illustrated embodiment may be commonly referred to as an "anvil".

Optionally, one or more dies is coupled to, or integrally formed into, the pressing surface 112 of the crimp tooling member 108 and/or the pressing surface 114 of the crimp tooling member 110. In the illustrated embodiment, the pressing surface 112 of the crimp tooling member 108 includes a die 122. The die 122 may include a complementary size and/or shape relative to the electrical terminal 10 and/or the electrical wire 28 before crimping and/or relative to a predetermined crimped size and/or shape of the assembly of the electrical terminal 10 and the electrical wire 28.

As discussed above, the actuator 106 is configured to move the crimp tooling members 108 and 110 toward each other along the crimping axis 120 to crimp the electrical terminal 10 to the electrical wire 28. Optionally, the actuator 106 is also configured to move the crimp tooling members 108 and 110 away from each other along the crimping axis 120 after the electrical terminal 10 and the electrical wire 28 have been crimped together. In addition or alternatively, another mechanism (not shown) is used to move the crimp tooling members 108 and 110 away from each other along the crimping axis 120 and thereby return the crimp tooling members 108 and 110 to the pre-crimp positions thereof. For example, a spring and/or other biasing mechanism may be operatively connected to the crimp tooling member 108 and/or the crimp tooling member 110 for biasing the crimp tooling member 108 and/or 110 to the pre-crimped position such that the crimp tooling members 108 and 110 move away from each other along the crimping axis 120 after the electrical terminal 10 and the electrical wire 28 have been crimped together. The crimp tooling members 108 and 110 are shown in the pre-crimped position in FIG. 3.

The actuator 106 may be any type of actuator that enables the actuator 106 to move the crimp tooling members 108 and 110 toward each other along the crimping axis 120 and thereby crimp the electrical terminal 10 and the electrical wire 28 together. Moreover, the actuator 106 may be operatively connected to the crimp tooling member 108 and/or the crimp tooling member 110 using any suitable mechanism, structure, and/or the like that enables the actuator to move the crimp tooling members 108 and 110 toward each other along the crimping axis 120. Examples of suitable types of actuators 106 include, but are not limited to, an explosive charge, compressed gas, compressed fluid, combustion of a fuel, a spring, an electromagnetic pulse, a linear engine, a rail gun, and/or the like. In the illustrated embodiment, the actuator 106 is an explosive charge that uses the energy (i.e., explosive forces) generated by the burning of a chemical explosive to move the crimp tooling members 108 and 110 toward each other along the crimping axis 120. Moreover, in the illustrated embodiment, the actuator 106 is operatively connected to the crimp tooling member 108 through a plunger 124 that is moved along the crimping axis 120 in the direction of the arrow A by the energy generated by the explosive charge of the actuator 106 to thereby move the crimp tooling members 108 and 110 toward each other along the crimping axis 120.

As described above, the electrical conductors 30 of the electrical wire 28 are fabricated from aluminum in the illustrated embodiment. One disadvantage of using aluminum as an electrical conductor material is an oxide and/or other surface material (such as, but not limited to, residual wire extrusion enhancement materials, and/or the like) layer that may build on the exterior metallic (i.e., aluminum) surface of the electrical conductor 30, for example when the conductor is exposed to atmosphere and/or during processing (e.g., an extrusion process and/or the like) of the electrical conductor 30. Such oxide and/or other surface material layers may be formed on other conductor materials besides aluminum, but can be especially difficult to deal with for aluminum. It should be understood that the embodiments of methods and crimp tools described and/or illustrated herein are applicable and may be used with embodiments wherein one or more of the electrical conductors 30 is fabricated from a different material than aluminum. Moreover, the embodiments of methods and crimp tools described and/or illustrated herein will be described below with respect to oxide layers 128, but it should be understood that the methods and crimp tools described and/or illustrated herein may be used with respect to other surface material layers in addition or alternative to the oxide layers 128.

Figure 4:
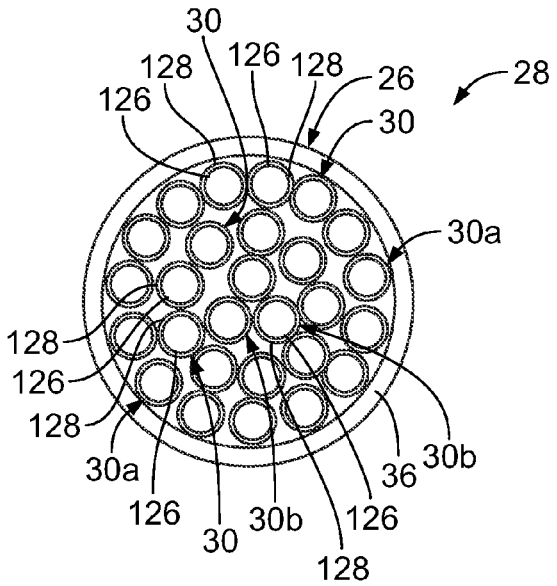
FIG. 4 is a cross-sectional view of the electrical wire shown in FIGS. 2 and 3 illustrating the electrical wire before the electrical terminal and the electrical wire have been crimped together.

For example, FIG. 4 is a cross-sectional view of the end 26 of the electrical wire 28 illustrating the end 26 of the electrical wire 28 before the electrical terminal 10 and the electrical wire 28 have been crimped together. The electrical wire 28 includes a bundle of the electrical conductors 30 and the electrical insulation layer 36, which surrounds the bundle of the electrical conductors 30. The electrical wire 28 may include any number of the electrical conductors 30.

The electrical conductors 30 of the electrical cable 28 include a group of exterior electrical conductors **30*a* that form a perimeter of the bundle of the electrical conductors 30. The electrical conductors 30 include a group of interior electrical conductor 30*b* that are surrounded by the exterior electrical conductors 30*b*. Each electrical conductor 30 includes a metallic surface 126 that defines an exterior surface of the aluminum material of the electrical conductor 30. The electrical conductors 30 also include oxide layers 128 that are formed on the metallic surfaces 126 of the electrical conductors 30, for example when the electrical conductors 30 are exposed to air. The oxide layers 128 have relatively poor electrical conductivity. Accordingly, to establish a reliable electrical connection between the electrical conductor 30 and another electrical conductor 30 and/or the crimp barrel 20, the oxide layer 128 must be displaced to expose and make physical contact to the metallic surface 126 of the electrical conductor 30, for example as part of a crimping process. The thickness of the oxide layers 128 may be exaggerated in FIG. 4 to better illustrate the oxide layers 128**.

Referring again to FIG. 3, the actuator 106 is configured to crimp the electrical terminal 10 and the electrical wire 28 together such that the metallic surfaces 126 of at least some of the electrical conductors 30 of the electrical wire 28 form hot weld bonds with the metallic surface(s) 126 of one or more adjacent electrical conductors 30. In conventional crimping operations, the bonds between the metallic surfaces 126 are formed through cold welds that form where contact portions of the metallic surfaces 126 come into physical contact with each other, for example by extruding between the oxide layers 128 (if the oxide layers 128 exist). "Cold welds" are solid state bonds formed without fusion between the contact portions of the metallic surfaces 126 that come into physical contact with each other. Cold welds are sometimes referred to as "adhesion" or "solid state" bonds. But, the crimping operations described and illustrated herein provide a reliable and sufficient electrical connection between the various individual electrical conductors 30 of the electrical wire 28 using a higher energy crimping process than conventional crimping processes. Specifically, the actuator 106 is configured to crimp the electrical terminal 10 and the electrical wire 28 together such that at least some contact portions of the metallic surfaces 126 of at least some of the electrical conductors 30 form hot weld bonds with one or more contact portions of the metallic surface 126 of one or more adjacent electrical conductors 30. "Hot weld bonds" are liquid state bonds that are formed from a fusion welding process where the contact portions of the metallic surfaces 126 melt and fuse together. The actuator 106 may also be configured to crimp the electrical terminal 10 and the electrical wire 28 together such that one or more contact portions of the interior surfaces 40 and/or 42 of the crimp barrel 20 form hot weld bonds with one or more contact portions of the metallic surface 126 of one or more of the exterior electrical conductors 30*a*. Any hot weld bonds formed between the crimp barrel 20 and an exterior electrical conductor 30*a* provide reliable and sufficient electrical connections between the crimp barrel 20 and the electrical conductors 30 of the electrical wire 28.

The actuator 106 is configured to impart sufficient frictional energy between adjacent electrical conductors 30 to cause the hot weld bonds to form by controlling the speed of the movement of the crimp tooling members 108 and 110 relative to each other. Specifically, as the crimp tooling members 108 and 110 press the crimp barrel 20 against the electrical conductors during the crimping operation, the electrical conductors 30 wipe (i.e., slide) against adjacent electrical conductors 30 and the crimp barrel 20. The wiping displaces and/or breaks open any existing oxide layers 128 of the electrical conductors 30 and thereby exposes the contact portions of the metallic surfaces 126 of the electrical conductors 30.

The sliding of the electrical conductors 30 against each other and the crimp barrel 20 during the crimping operation creates frictional forces between adjacent electrical conductors 30 and between the exterior electrical conductors 30*a* (FIGS. 4-6) and the crimp barrel 20. As the electrical conductors 30 slide against each other and the crimp barrel 20 and the attendant oxide displacement and/or metallic extrusion occurs, with enough frictional energy dissipation, at least some of the contact portions of the metallic surfaces 126 can experience melting to form the hot weld bonds. In some embodiments, a cross-sectional area index reduction as a result of the crimping operation of at least approximately 80% is required to get sufficient extrusion to form a sufficient and reliable electrical connection between the contact portions.

The speed of the crimp tooling members 108 and 110 controls the amount of frictional energy that is generated by the electrical conductors 30 sliding against each other and the crimp barrel 20 as the crimp barrel 20 is pressed against the electrical conductors 30. Specifically, the speed of the movement of the crimp tooling members 108 and 110 toward each other determines the duration of time over which the frictional energy is applied to the electrical conductors 30. The actuator 106 is configured to apply the frictional energy to the electrical conductors 30 over a duration of time that is short enough to melt at least some of the contact portions of the metallic surfaces 126. Specifically, the actuator 106 is configured to move the crimp tooling members 108 and 110 toward each other with a sufficiently high speed such that the frictional forces generate a sufficient amount of heat in the time it takes to form the crimp to cause melting of at least some of the contact portions of the metallic surfaces 126 of the electrical conductors 30 before the generated heat can dissipate along the lengths of the electrical conductors 30. In other words, the speed of the movement of the crimp tooling members 108 and 110 toward each other is sufficiently high to generate a quasi-adiabatic condition that melts at least some of the contact portions of the metallic surfaces 126 of the electrical conductors 30 (and/or the contact portions of the surfaces 40 and/or 42 of the crimp barrel 20) as the contact portions are formed.

As described above, the actuator 106 provides the relative movement of the crimp tooling members 108 and 110 with a sufficiently high speed to melt at least some of the contact portions of the metallic surfaces 126 and form the hot weld bonds, which prevents the exposed contact portions from forming new oxidation layers thereon at the hot weld bonds. In other words, the metallic material of the contact portions of the metallic surfaces 126 form the hot weld bonds without any subsequent oxides layer forming between the contact portions at the location of the hot weld bonds. The hot weld bonds thus form sufficient and reliable electrical connections because the hot weld bonds are formed between the contact portions of the metallic surfaces 126 (and/or between a contact portion of a metallic surface 126 and a contact portion of an interior surface 40 and/or 42 of the crimp barrel 20) without any intervening oxide layers 128 (although some residual oxide material may remain present).

Of course, in addition to the hot weld bonds, the crimping operations described and illustrated herein may also form cold welds between some of the contact portions of the metallic surfaces 126 of the electrical conductors 30 (and/or between one or more contact portions of the surfaces 40 and/or 42 of the crimp barrel 20 and one or more contact portions of one or more electrical conductors 30) that did not experience enough frictional heat dissipation during the crimping operation to convert from the solid state to the liquid state (i.e., to melt).

Figure 5:
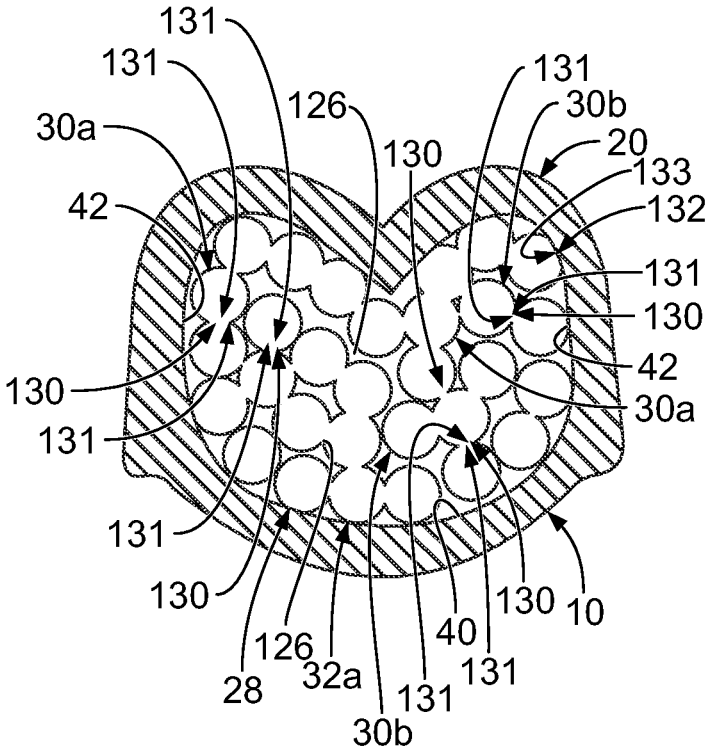
FIG. 5 is a cross-sectional view of the electrical terminal shown in FIG. 2 taken along line 5-5 of FIG. 2.
Figure 6:
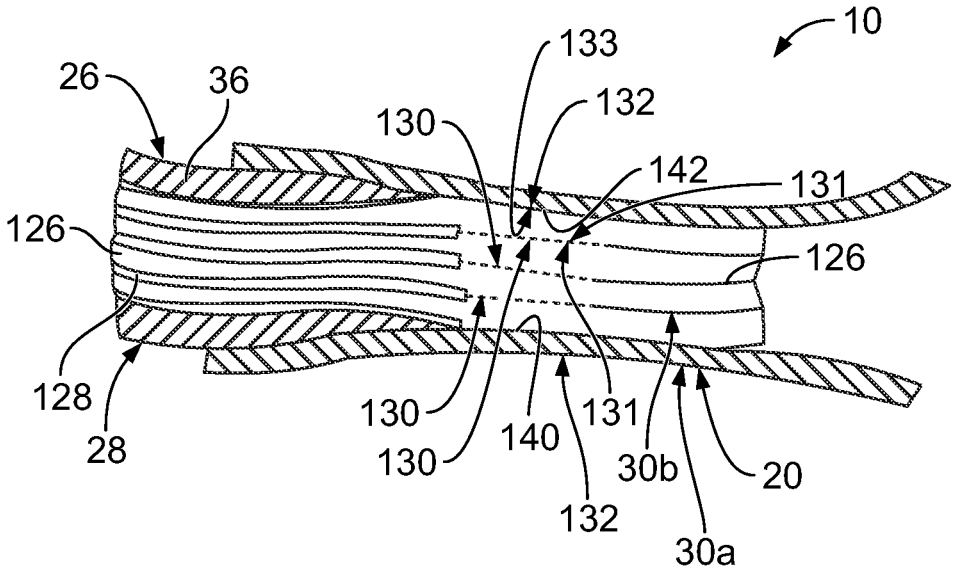
FIG. 6 is a longitudinal cross-sectional view of the electrical terminal shown in FIG. 2 taken through the length of the electrical terminal

FIGS. 5 and 6 illustrate the hot weld bonds. Specifically, FIG. 5 is a cross-sectional view of the electrical terminal 10 taken along line 5-5 of FIG. 2. FIG. 6 is a longitudinal cross-sectional view of the electrical terminal 10 taken through the length of the electrical terminal 10. FIGS. 5 and 6 illustrate the electrical terminal 10 after the crimp barrel 20 has been crimped to the electrical wire 28. As can be seen in FIGS. 5 and 6, the crimping operation has been applied by the actuator 106 (FIG. 3) such that hot weld bonds 130 are formed between at least some of the contact portions 131 of at least some adjacent electrical conductors 30. Optionally, hot weld bonds 132 are formed between at least some of the contact portions 131 of at least some of the exterior electrical conductors 30*a* and the crimp barrel 20.

Specifically, the contact portions 131 of the metallic surfaces 126 of at least some of the interior electrical conductors 30*b* have been exposed through the corresponding oxide layer 128 (not visible in FIG. 5). At least some of the contact portions 131 have melted formed the hot weld bonds 130 with a contact portion 131 of the metallic surface 126 of one or more adjacent interior electrical conductors 30*b*. Moreover, at least some of the contact portions 131 of at least some of the interior electrical conductors 30*b* have formed the hot weld bonds 130 with a contact portion 131 of the metallic surface 126 of one or more adjacent exterior electrical conductors 30*a*. At least some of the contact portions 131 of at least some of the exterior electrical conductors 30*a* have formed the hot weld bonds 130 with a contact portion 131 of the metallic surfaces 126 of one or more adjacent exterior electrical conductors 30*a*. In the illustrated embodiment, at least some contact portions 133 of the interior surfaces 40 and/or 42 of the crimp barrel 20 have formed the hot weld bonds 132 with at least some contact portions 131 of the metallic surfaces 126 of at least some of the exterior electrical conductors 30*a*. The weld bonds 130 provide sufficient and reliable electrical connections between the electrical conductors 30. The weld bonds 132 provide sufficient and reliable electrical connections between the electrical conductor 30 and the crimp barrel 20. The electrical conductors 30 of the electrical cable 28 are thus electrically connected to the crimp barrel 20 such that the electrical terminal 10 is electrically connected to the electrical wire 28.

Optionally, the crimp barrel 20 includes the serrations 44 (FIG. 1), which assist in penetrating the oxide layers 128 of the exterior electrical conductors 30*a* to facilitate providing (in addition or alternative to the weld bonds 132) a sufficient and reliable electrical connection between the exterior electrical conductors 30*a* and the crimp barrel 20.

Referring again to FIG. 3, the actuator 106 is configured to control the speed of the movement of the crimp tooling members 108 and 110 toward each other to form the hot weld bonds 130 and/or 132 (FIGS. 5 and 6). It should be understood that the speed of the relative movement between the crimp tooling members 108 and 110 is variable along the length of travel of the crimp tooling members 108 and 110 toward each other. Specifically, the crimp tooling members 108 and 110 will be accelerated from a starting position of the crimp tooling members 108 and 110 to an ultimate speed value, and will be decelerated from the ultimate speed value to stop the relative movement at a final crimped position of the crimp tooling members 108 and 110. The actuator 106 may be configured to move the crimp tooling members 108 and 110 toward each other at any ultimate speed value that enables the crimping operation to melt at least some of the contact portions 131 (FIGS. 5 and 6) of the metallic surfaces 126 of at least some of the electrical conductors 30 and form at least some of the hot weld bonds 130 and/or 132 (FIGS. 5 and 6). Examples of the ultimate speed value at which the actuator 106 may move the crimp tooling members 108 and 110 toward each other include, but are not limited to, at least approximately 30 meters per second (m/s), at least approximately 40 m/s, at least approximately 45 m/s, at least approximately 50 m/s, and/or the like.

It should be understood that the ultimate speed value at which the actuator 106 moves the crimp tooling members 108 and 110 toward each other to form the hot weld bonds 130 and/or 132 may each depend on various factors, such as, but not limited to, the coefficient of friction between the components that slide against each other (e.g., two electrical conductors 30 or an electrical conductor 30 and the crimp barrel 20), the amount of force required to complete the crimping operation for the particular types of the electrical terminal 10 and the electrical wire 28, the geometry and/or materials of the crimp barrel 20, the geometry of the electrical cable 28, and/or the like. For example, the ultimate speed value sufficient to form the hot weld bonds 130 and/or 132 may depend on the length of travel of the movement of the crimp tooling members 108 and 110 toward each other required to complete the crimp, which is determined based on the geometry (e.g., the size and/or shape) of the crimp barrel 20 and/or the electrical cable 28.

As described above, the actuator 106 may be any type of actuator that enables the actuator 106 to move the crimp tooling members 108 and 110 toward each other along the crimping axis 120 and thereby crimp the electrical terminal 10 and the electrical wire 28 together. In the illustrated embodiment, the actuator 106 is an explosive charge that uses the energy (i.e., explosive forces) generated by the burning of a chemical explosive to move the crimp tooling members 108 and 110 toward each other along the crimping axis 120. The explosive charge may be configured to produce any amount of energy that enables the actuator 106 to provide the ultimate speed value (of the relative movement of the crimp tooling members 108 and 110) that enables the crimping operation to form the hot weld bonds 130 and/or 132. When other types of actuators 106 are used, such other types of actuators 106 may be configured to apply any amount of force to the crimp tooling members 108 and/or 110 that enables the crimping operation to form the hot weld bonds 130 and/or 132. For example, when the actuator 106 is a spring, the spring may be configured to apply any amount of spring force to the crimp tooling members 108 and/or 110 that enables the crimping operation to form the hot weld bonds 130 and/or 132.

Figure 7:
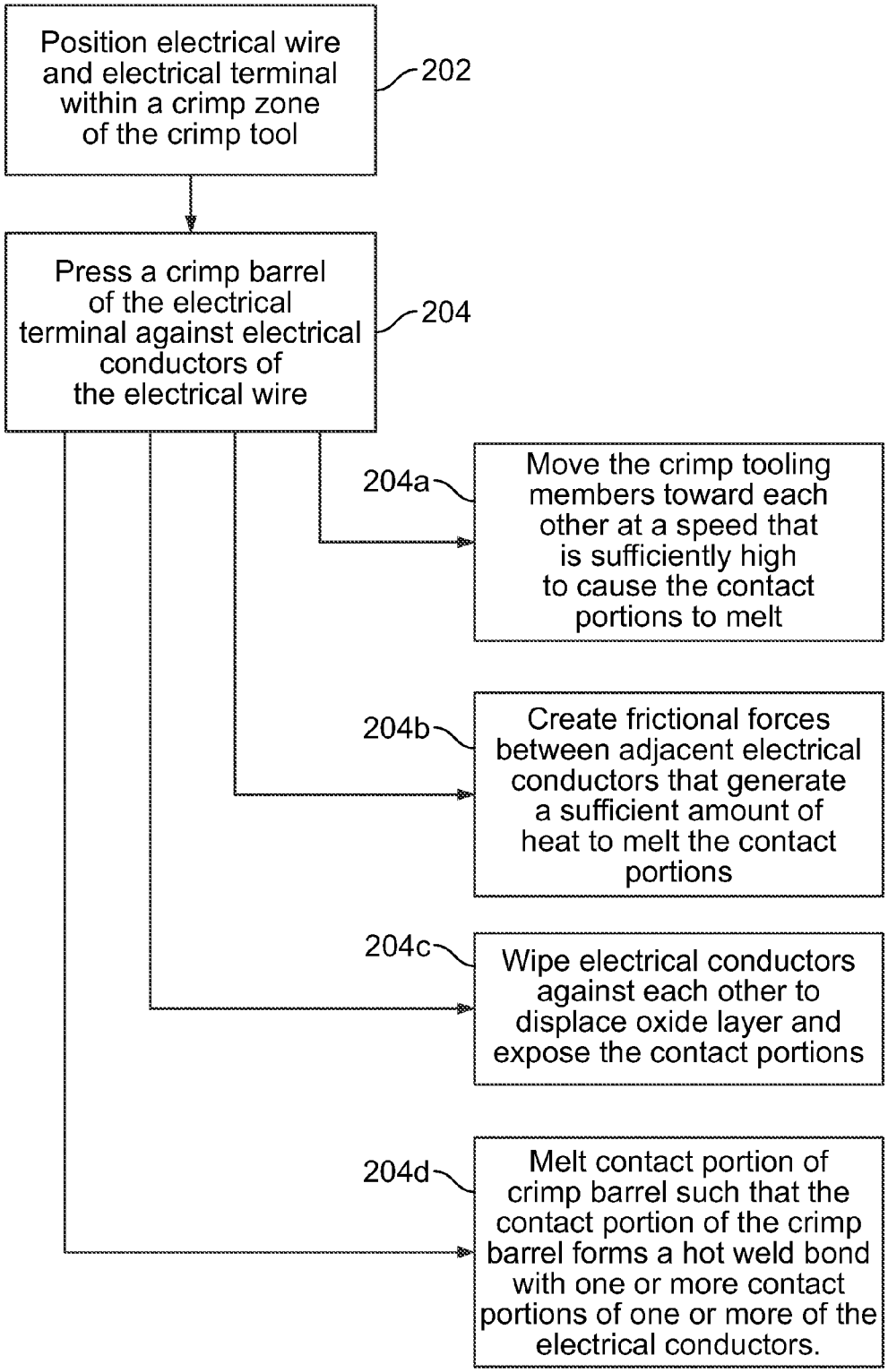
FIG. 7 is a flowchart of an embodiment of a method for crimping the electrical terminal shown in FIGS. 1-3, 5, and 6 to the electrical wire shown in FIGS. 2-6.

FIG. 7 is a flowchart of an embodiment of a method 200 for crimping an electrical terminal (e.g., the electrical terminal 10 shown in FIGS. 1-3, 5, and 6) to an electrical wire (e.g., the electrical wire 28 shown in FIGS. 2-6). The method 200 may be performed by a crimp tool, such as, but not limited to, the crimp tool 100 shown in FIG. 3. The method 200 includes positioning, at 202, the electrical wire and the electrical terminal within a crimp zone (e.g., the crimp zone 118 shown in FIG. 3) that extends between opposing crimp tooling members (e.g., the crimp tooling members 108 and 110 shown in FIG. 3) of the crimp tool. The electrical wire and the electrical terminal may be assembled together before being positioned at 202 within the crimp zone. Alternatively, the electrical terminal and the electrical wire may be separately positioned within the crimp zone, whether at different times and/or simultaneously with each other. Either the electrical wire or the electrical terminal may be positioned within the crimp zone before the other when the electrical terminal and the electrical wire are separately positioned within the crimp zone at different times.

At 204, the method 200 includes pressing a crimp barrel (e.g., the crimp barrel 20 shown in FIGS. 1-3, 5, and 6) of the electrical terminal against electrical conductors (e.g., the electrical conductors 30 shown in FIGS. 2-6) of the electrical wire using the crimp tooling members such that the electrical conductors are mechanically and electrically connected to the crimp barrel. The crimp barrel is pressed at 204 against the electrical conductors such that at least some of the contact portions (e.g., the contact portions 131 shown in FIGS. 5 and 6) of the metallic surfaces (e.g., the metallic surfaces 126 shown in FIGS. 4-6) of at least some of the electrical conductors melt and form hot weld bonds with one or more of the contact portions of the metallic surface of one or more adjacent electrical conductors. The metallic surfaces are melted and the hot weld bonds are formed before oxidation layers form on the contact portions at the locations of the hot weld bonds.

Pressing at 204 the crimp barrel against the electrical conductors includes moving the crimp tooling members toward each other at a speed that is sufficiently high to cause at least some of the contact portions of the metallic surfaces of at least some of the electrical conductors to melt. Moreover, pressing at 204 the crimp barrel against the electrical conductors includes creating, at 204*b*, frictional forces between adjacent electrical conductors that generate a sufficient amount of heat to melt at least some of the contact portions of the metallic surfaces of at least some of the electrical conductors.

In some embodiments, pressing at 204 the crimp barrel against the electrical conductors may include wiping, at 204*c*, adjacent electrical conductors against each other such that oxide layers of the adjacent electrical conductors are displaced to expose the contact portions of the metallic surfaces of the electrical conductors.

Optionally, pressing at 204 the crimp barrel against the electrical conductors comprises melting, at 204*d*, a contact portion (e.g., the contact portions 133 shown in FIGS. 5 and 6) of a metallic surface (e.g., the surfaces 40 and/or 42 shown in FIGS. 1, 5, and 6) of the crimp barrel such that the contact portion of the metallic surface of the crimp barrel forms a hot weld bond with one or more contact portions of the metallic surface of one or more of the electrical conductors.

The embodiments described and/or illustrated herein provide a method and apparatus for crimping an electrical terminal to an electrical wire, wherein the crimping operation provides a sufficient and reliable electrical connection between the electrical terminal and the electrical wire. The embodiments described and/or illustrated herein may provide a method and apparatus that provides a more sufficient and more reliable electrical connection between an electrical terminal and an electrical wire as compared to at least some known crimping methods and apparatus. The embodiments described and/or illustrated herein may provide a method and apparatus that more easily crimps an electrical terminal to an electrical wire as compared to at least some known crimping methods and apparatus.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A method for crimping an electrical terminal to an electrical wire having electrical conductors, the method comprising:

positioning the electrical wire and the electrical terminal between opposing crimp tooling members of a crimp tool; and pressing a crimp barrel of the electrical terminal against the electrical conductors of the electrical wire during a high speed crimping operation using the crimp tooling members such that the crimp barrel is crimped around the electrical conductors to mechanically and electrically the electrical conductors to the crimp barrel, wherein the crimp tooling members move relative to each other at a speed of at least approximately 30 meters per second and press the crimp barrel against the electrical conductors such that at least some contact portions of metallic surfaces of at least some of the electrical conductors melt and form hot weld bonds with one or more contact portions of the metallic surfaces of one or more adjacent electrical conductors during the high speed crimping operation.

2. The method of claim 1, wherein pressing the crimp barrel against the electrical conductors comprises moving the crimp tooling members toward each other at a speed that is sufficiently high to cause the at least some contact portions of the metallic surfaces to melt.

3. The method of claim 1, wherein pressing the crimp barrel against the electrical conductors comprises creating frictional forces between adjacent electrical conductors that generate a sufficient amount of heat to melt the at least some contact portions of the metallic surfaces.

4. The method of claim 1, wherein pressing the crimp barrel against the electrical conductors comprises applying frictional energy between adjacent electrical conductors over a duration of time that is short enough to melt the at least some contact portions of the metallic surfaces.

5. The method of claim 1, wherein the electrical conductors are aluminum electrical conductors, and wherein pressing the crimp barrel against the electrical conductors using the crimp tooling members comprises wiping adjacent electrical conductors against each other such that oxide layers of the adjacent electrical conductors are displaced to expose the contact portions of the metallic surfaces of the electrical conductors.

6. The method of claim 1, wherein pressing the crimp barrel against the electrical conductors comprises forming the hot weld bonds before an oxidation layer is formed on the at least some contact portions of the metallic surfaces at the locations of the hot welds.

7. The method of claim 1, wherein pressing the crimp barrel against the electrical conductors using the crimp tooling members comprises melting at least one contact portion of a metallic surface of the crimp barrel such that the at least one contact portion of the metallic surface of the crimp barrel forms a hot weld bond with one or more contact portions of the metallic surface of one or more of the electrical conductors.

8. The method of claim 1, wherein pressing the crimp barrel against the electrical conductors using the crimp tooling members comprises moving the crimp tooling members toward each other using an explosive charge.

9. The method of claim 1, wherein pressing the crimp barrel against the electrical conductors using the crimp tooling members comprises moving the crimp tooling members toward each other using at least one of compressed gas, compressed fluid, combustion of a fuel, a spring, an electromagnetic pulse, a rail gun, or a linear engine.

* * * * *